US006131737A

United States Patent [19]

Marshall

[11] Patent Number: 6,131,737

[45] **Date of Patent: *Oct. 17, 2000**

[54] DISPLAY PACKAGE FOR PULL CHAINS AND THE LIKE

[76] Inventor: John C. Marshall, P.O. Box 45669, Baton Rouge, La. 70895

[ * ] Notice: This patent is subject to a terminal disclaimer.

[21] Appl. No.: 09/102,427

[22] Filed: Jun. 24, 1998

[51] Int. Cl.[7] ..... B65D 73/00; A44B 7/00

[52] U.S. Cl. ..... 206/471; 206/348; 206/525

[58] Field of Search ..... 206/461–463, 206/471, 525, 348, 806; D9/415

[56] References Cited

U.S. PATENT DOCUMENTS

| | | | |
|---|---|---|---|
| D. 190,396 | 5/1961 | Robinson | 206/461 X |
| D. 205,478 | 8/1966 | Christine et al. | D9/415 |
| D. 351,556 | 10/1994 | Reil | D9/415 |
| 3,165,234 | 1/1965 | Conklin et al. | 206/806 X |
| 3,202,269 | 8/1965 | Lewis et al. | 206/461 |
| 3,211,503 | 10/1965 | Barnes | 206/461 X |
| 3,356,210 | 12/1967 | Lilly | 206/461 X |
| 3,371,777 | 3/1968 | Lilly | 206/461 X |
| 4,132,312 | 1/1979 | Kamada | 206/461 |
| 4,854,450 | 8/1989 | Fisher | 206/461 X |
| 5,090,570 | 2/1992 | Todd | 206/463 |
| 5,540,324 | 7/1996 | Knapp | 206/348 X |
| 5,878,886 | 3/1999 | Marshall | 206/470 |

*Primary Examiner*—Bryon P. Gehman
*Attorney, Agent, or Firm*—Liniak, Berenato, Longacre & White, LLC

[57] ABSTRACT

A blister pack for displaying pull chains which includes a transparent cover member having connecting first, second and third recesses for receiving a pull chain, the second recess having a holding region to lock the chain in place. The package further has a flat base member disposed over the cover member and completely covering the recesses. The cover member and the base member are joined together. A method of displaying pull chains in a display package, wherein the chain of a pull chain is locked into a holding region of a transparent cover member such that the knob of the pull chain is permitted to be displayed in a manner which more realistically portrays the appearance same would have when affixed to a ceiling fan.

18 Claims, 1 Drawing Sheet

DISPLAY PACKAGE FOR PULL CHAINS AND THE LIKE

FIELD OF THE INVENTION

The disclosed invention is a display package for pull chains and similar articles sold to consumers by retailers and others. More particularly, the disclosed invention relates to a blister pack with a unique blister, in that the blister enables a pull chain to be locked in place so the pull chain will hang in the package and suspend the knob to more realistically portray the appearance as same would occur when affixed to a ceiling fan.

BACKGROUND OF THE INVENTION

Retail establishments are under constraints to reduce costs while increasing sales. Suppliers to retail establishments are encountering similar constraints and demands, with retailers limiting display space to those products which achieve maximum sales potential. The manner in which a product is displayed, and thereby perceived by a consumer, frequently has a strong impact on sales of a packaged product. In addition, particularly with relatively small items, it is preferred that the package construction, size, or the like provide theft resistance.

A ceiling fan typically has a relatively short chain connected to a speed switch, with the switch being adjusted to set the speed of rotation of the fan blades to that which is desired. The short chain may not be reachable by the user, or same may be considered unattractive. Many consumers attach an extension chain to the short chain which comes with the fan, and the extension chain typically has a decorative knob or like ornament at its end. The knob and the chain may be colored or otherwise decorated in order to match the decor of the ceiling fan, the room in which the ceiling fan is positioned, or some other aesthetically pleasing attribute.

Ceiling fan extension pull chains have in the past been displayed to consumers on bubble cards. The typical bubble card has a cardboard base to which a transparent bubble is secured. The extension chain and its knob are positioned within the bubble, and the card may be hung from a hook. In that configuration, however, the chain and knob are not presented to the consumer in an orientation corresponding to the orientation same would achieve when connected to the chain of a ceiling fan. The bubble package does not permit the consumer to easily recognize the coloring of the chain, or the ornamentation on the knob. The consumer must imagine how the chain and knob will appear with this sort of package, with the result that sales potential is potentially diminished.

Attempts have been made to increase consumer perception of the extension chain by display of the chain and its knob in a transparent carton having a cardboard insert. These carton-type packages, however, do not display the extension chain and its knob in an orientation and configuration as would be achieved hanging from a ceiling fan. Additionally, portions of the chain remain loose in the package, and thus detract from an aesthetically pleasing appearance. Moreover, the carton-type package is relatively expensive to manufacture, and is relatively complicated to assemble.

U.S. patent application Ser. No. 08/716,903, now U.S. Pat. No. 5,878,886 discloses a display package for pull chains and the like wherein the package is a clam shell package in which an insert is positioned for holding the chain of a pull chain, so that the knob is suspended in a chamber to more realistically portray the appearance as the same would occur with affixed to a ceiling fan. According to this application, the insert has a capture region for engaging an article, so that a portion of the article is disposed within a chamber for display. However, assembling such packages is labor intensive.

Those skilled in the art will appreciate that there is a need for a relatively inexpensive, easy to manufacture, aesthetically pleasing package suitable for display of ceiling fan extension pull chains, other sorts of pull chains, and similar types of products. The disclosed invention meets these needs and others in the art through the provision of a blister pack with a transparent blister having a holding region configured to lock the chain of a pull chain in place to allow the decorative knob to hang vertically in an open area, resulting in an appearance approximating the appearance of the pull chain and knob when hung from a ceiling fan.

SUMMARY OF THE INVENTION

A package for displaying pull chains and the like comprises a transparent cover member having connecting first, second and third recesses for receiving a pull chain. The second recess has a holding region configured to lock the chain in place. The package additionally has a flat base member disposed over the cover member, and completely covering the recesses. A seal joins the base member to the cover member.

A package for displaying a pull chain comprises a blister body having connecting first, second and third recesses for receiving a pull chain. The second recess has a groove for locking at least one link of the chain in place. A card is disposed over the blister body, completely covering the recesses and is sealed to the body.

A display package for displaying pull chains comprises a transparent cover member having connecting first, second and third recesses for receiving a pull chain. The second recess has a holding region for locking the chain in place. A substantially flat base member is secured to the cover member, and covers the recesses completely. The package further comprises a pull chain to be displayed, which pull chain includes a chain and a knob. The chain is locked into the holding region and the knob is suspended from the chain and displayed within the third recess.

A method of displaying pull chains in a display package includes a pull chain having a chain and a knob, and wherein the display package comprises a transparent cover member having connecting first, second and third recesses for receiving the pull chain. The second recess has a holding region configured to lock the chain in place. The package further has a flat base member. The method comprises the steps of locking the chain into the holding region, placing the knob in the third recess and the excess chain in the first recess, and sealing the base member and the cover member in overlying position to the recesses.

These and other objects and advantages of the invention will be readily apparent in view of the following description and drawings of the above-described invention.

DESCRIPTION OF THE DRAWINGS

The above and other advantages and novel features of the present invention will become apparent from the following detailed description of the preferred embodiment of the invention illustrated in the accompanying drawings, wherein.

DETAILED DESCRIPTION OF THE INVENTION

Figure 1:
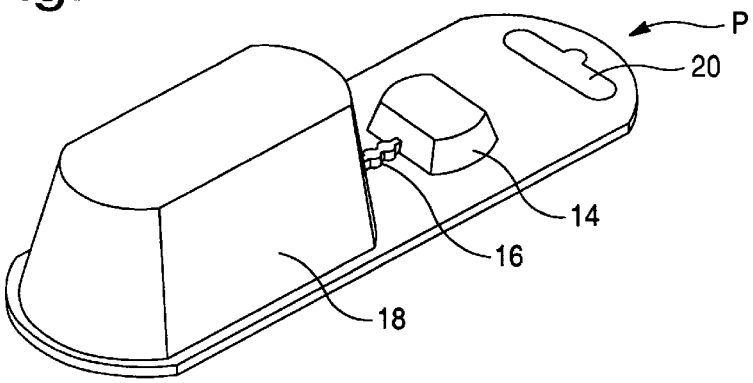
FIG. 1 is a perspective view of the package of the invention.

Package P, as best shown in FIG. 1, is a blister pack having a transparent cover member 10 joined to a flat base member 12. The transparent cover member 10 has connecting first 14, second 16, and third 18 recesses for receiving a pull chain. The transparent cover member 10 is integral, and is preferably made of a polymeric material, such as a plastic of the sort suitable for vacuum molding. In view of the fact that the plastic is transparent, a consumer may easily view the contents of the package P.

The base member 12 of the package P is preferably formed of a fibrous material, such as cardboard or chipboard. Because the flat base member 12 is cardboard or other similar fibrous material which may be printed upon, the base member 12 is available to provide consumer information about the product being displayed, its manufacturer, price, and like information. Package P preferably has a triangular opening 20 formed in an upper portion of package P, permitting the package P to be hung from a hook or other sort of fixture at the retail store.

Figure 2:
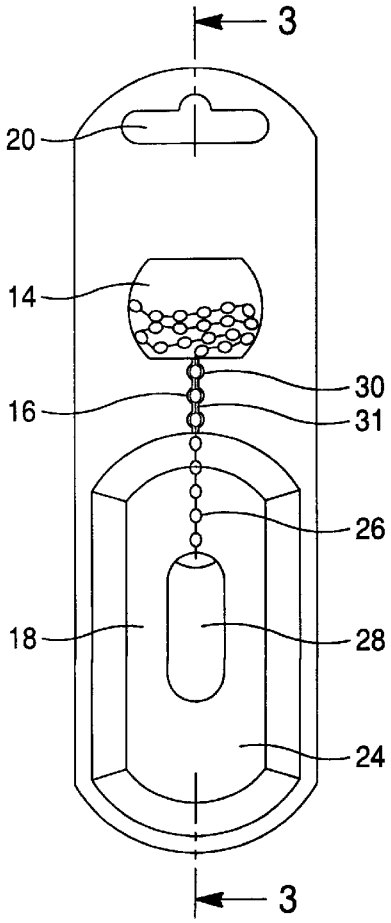
FIG. 2 is a front elevational view thereof.
Figure 3:
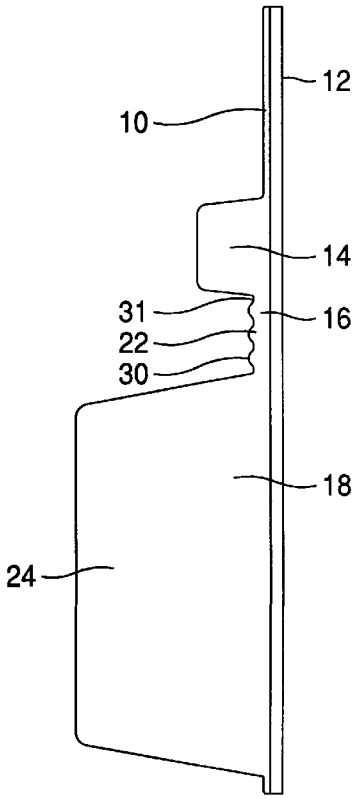
FIG. 3 is a cross sectional view taken along the line 3—3 of FIG. 2, viewed in the direction of the arrows, with the chain removed for clarity.

The package P has a length dimension and the second recess 16 is longitudinally aligned along the length dimension between the first 14 and third 18 recesses. The package P further has a a width dimension, and the second recess 16 extends in the length dimension and is centrally disposed relative to the width dimension. The second recess 16 is spaced longitudinally from the first recess 14, and the third recess 18 is spaced longitudinally from the second recess 16. Furthermore, the first recess 14 is preferably slightly larger than the second recess 16, and the third recess 18 is preferably larger than the first recess 14. The first recess 14 and the third recess 18 are connected by second recess 16. Recesses 14 and 18 are preferably longitudinally aligned. The second recess 16 has a holding region 22, as best shown in FIGS. 2 and 3, configured to lock a chain in place. Third recess 18 forms an open chamber 24 which is sized and configured for receipt and display of a preselected article. Preferably, the chamber 24 is larger than the article, so that the article achieves a realistic orientation when the package P is hung vertically for display.

The article to be displayed is preferably a ceiling fan extension chain, comprising a ball chain 26 and a knob 28, wherein the chamber 24 is sized and configured to receive the knob 28, as best shown in FIG. 2. The chain 26 may be brass or otherwise colored, with the knob 28 having essentially any configuration and ornamentation desired. As best seen in FIG. 2, package P is designed such that the chain 26 and the knob 28 hang vertically within chamber 24, so that they accurately represent the orientation which the chain 26 and knob 28 would have when attached to a ceiling fan. The consumer may thus more realistically and easily appreciate the appearance that the chain 26 and the knob 28 would convey when hung from the ceiling fan, thus potentially increasing the likelihood of a sale. Furthermore, because the chain 26 extends along the holding region 22 of the second recess 16, maximum display of the chain length consistent with package dimensions is provided.

In order to secure the chain 26 so that the chain 26 and the knob 28 hang vertically in essentially a longitudinally immoveable manner when the package P is hung from a hook extending through opening 20, holding region 22 is provided with a groove 30 having detents 31 configured to lock at least one link of the chain 26 in place. While three detents 31 are disclosed, a greater or fewer number may be used and the configuration need not be spherical. As best seen in FIG. 3, the base member 12 is substantially flat and overlies the first 14, second 16 and third 18 recesses, and completely covers the recesses. Base member 12 is disposed behind second recess 16 and thereby keeps the chain 26 locked into holding region 22. Base member 12 also overlies the first recess 14 and therefore, the portion of the chain 26 which is not disposed within the second recess 16 and the third recess 18 is collected in the first recess 14. As a result, the remaining chain is held in first recess 14, such that it does not detract from the aesthetically pleasing appearance of the package P. The base member 12 is secured to the cover member 10 with an adhesive or other securing means.

In order to assemble the package P, the chain 26 is locked into holding region 22 by securing a link of the chain 26 into the detents 31 of groove 30 of the holding region 22. The chain 26 is secured in the holding region 22 to permit the knob 28 to hang freely and vertically within chamber 24 of third recess 18. The knob 28 is then placed in the chamber 24 of the third recess 18, and excess chain not in second recess 16 and third recess 18 is placed in first recess 14. The base member 12 is then sealed to the cover member 10, to completely close the recesses. Cover member 10 is preferably sealed to base member 12 with a blister machine. A blister machine combines heat, pressure, time, and a coating to obtain a proper seal. The chain 26 is further secured by sealing the base member 12 over the first 14 and second 16 recesses. The package P may then be shipped to the retailer, and hung by placing opening 20 about a hook or other fixture for display to the consumer.

While this invention has been described as having a preferred design, it is understood that it is capable of further modifications, usages, and/or adaptations of the invention. Following the general principles of the invention and including such departures from the present disclosure as come within known or customary practice in the art to which the invention pertains, and as may be applied to the central features set forth above, and fall within the scope of the invention of the limits of the appended claims.

What is claimed is:

1. A package for displaying pull chains, comprising:

a) a transparent cover member having a first recess, a second recess, and a third recess, said recesses being interconnected in the recited sequence and being longitudinally aligned for receiving a pull chain, said second recess having a holding region comprising at least a first detent to lock the chain in place;

b) a flat base member disposed over said cover member and completely covering said recesses; and c) a seal joining said base member to said cover member.

2. The package of claim 1, wherein said cover member is an integral polymeric member.

3. The package of claim 2, wherein said cover member is vacuum molded plastic.

4. The package of claim 1, wherein said base member is a fibrous material.

5. The package of claim 4, wherein said fibrous material is selected from the group consisting of cardboard and chipboard.

6. The package of claim 1, wherein the pull chain includes a knob, and said third recess is sized and configured to receive the knob.

7. The package of claim 6, wherein said first recess is sized and configured to receive excess chain not positioned in said second and third recesses.

8. The package of claim 1, wherein said members have a length dimension and a width dimension, and said second recess extends in said length dimension and is centrally disposed relative to said width dimension.

9. The package of claim 1, wherein said seal includes an adhesive.

10. The package of claim 1, wherein said first recess is greater in size than said second recess, and said third recess is greater in size than said first recess.

11. The package of claim 1, wherein an opening extends through the cover member and the base member adjacent said first recess for permitting the package to be hung on a fixture.

12. The display package of claim 1, wherein an opening is formed in said cover member and said base member adjacent said first recess for receiving a hook in order to permit the display package to be hung from a fixture.

13. A display package for displaying pull chains, comprising:

a) a transparent cover member having a first recess, a second recess, and a third recess and said recesses being interconnected for receiving a pull chain, said second said recess having a holding region for locking the chain in place;

b) a flat base member secured to said cover member and entirely covering said recesses; and c) a pull chain to be displayed including a chain and a knob, said chain locked in said holding region and said knob suspended from said chain and displayed within said third recess.

14. The display package of claim 13, wherein said first recess contains excess chain not displayed in said second and third recesses.

15. The display package of claim 13, wherein said holding region includes a groove having a configuration conforming to the configuration of at least one link of the chain.

16. A method of displaying a pull chain in a display package, wherein the pull chain includes a chain and a knob and said display package comprises a transparent cover member having connecting first, second, and third sequentially aligned recesses for receiving the pull chain, said second recess having a holding region configured to lock the chain in place, and a flat base member, comprising the steps of:

a. locking the chain into the holding region;

b. placing the knob in the third recess and excess chain not displayed in the second and third recesses in the first recess; and c. sealing the base member to the cover member in overlying position in relation to the recesses.

17. The method of claim 16, wherein said step of locking the chain into the holding region comprises the step of locking the chain into a groove configured to receive at least one link of the chain.

18. The method of claim 16, comprising the further step of suspending the display package vertically.

* * * * *